US008780038B2

(12) United States Patent
Flinner et al.

(10) Patent No.: US 8,780,038 B2
(45) Date of Patent: Jul. 15, 2014

(54) REFRIGERATOR COMPRISING A FUNCTION DISPLAY UNIT

(75) Inventors: Klaus Flinner, Zöschingen (DE); Georg Hausmann, Dillingen (DE); Stefan Holzer, Aalen (DE); Jörg Stelzer, Giengen/Brenz (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 22 days.

(21) Appl. No.: 11/017,616

(22) Filed: Dec. 20, 2004

(65) Prior Publication Data

US 2005/0156870 A1 Jul. 21, 2005

Related U.S. Application Data

(63) Continuation of application No. PCT/EP03/05865, filed on Jun. 4, 2003.

(30) Foreign Application Priority Data

Jun. 18, 2002 (DE) ..... 102 27 132

(51) Int. Cl.
*G09G 3/34* (2006.01)

(52) U.S. Cl.
USPC ..... 345/107; 359/296; 62/125

(58) Field of Classification Search
USPC ..... 345/107; 359/296
See application file for complete search history.

(56) References Cited

U.S. PATENT DOCUMENTS

| | | | | |
|---|---|---|---|---|
| 6,054,071 | A * | 4/2000 | Mikkelsen, Jr. | 264/1.36 |
| 6,118,426 | A | 9/2000 | Albert et al. | |
| 6,120,588 | A | 9/2000 | Jacobson | |
| 6,177,921 | B1 | 1/2001 | Comiskey et al. | |
| 6,323,989 | B1 | 11/2001 | Jacobson et al. | |
| 6,348,908 | B1 | 2/2002 | Richley et al. | |
| 6,445,489 | B1 * | 9/2002 | Jacobson et al. | 359/296 |
| 6,486,861 | B1 * | 11/2002 | Preas et al. | 345/87 |
| 6,526,766 | B1 * | 3/2003 | Hiraoka et al. | 62/125 |
| 6,577,433 | B1 * | 6/2003 | Lin et al. | 359/296 |
| 6,658,868 | B2 * | 12/2003 | Raab et al. | 62/126 |
| 6,724,520 | B2 * | 4/2004 | Kawai | 359/296 |
| 6,753,830 | B2 * | 6/2004 | Gelbman | 345/55 |
| 6,865,010 | B2 * | 3/2005 | Duthaler et al. | 359/296 |
| 7,167,155 | B1 * | 1/2007 | Albert et al. | 345/107 |
| 7,170,670 | B2 * | 1/2007 | Webber | 359/296 |
| 2002/0021483 | A1 * | 2/2002 | Katase | 359/267 |

FOREIGN PATENT DOCUMENTS

| | | | |
|---|---|---|---|
| DE | 43 21 103 | A1 | 1/1995 |
| EP | 0 987 674 | A2 | 3/2000 |
| WO | WO 0210659 | A1 * | 2/2002 |

* cited by examiner

*Primary Examiner* — Seokyun Moon
(74) *Attorney, Agent, or Firm* — Nixon & Vanderhye, P.C.

(57) ABSTRACT

A refrigerator has a function display panel mounted to the housing, for indicating functional states and/or operational parameters of the refrigerator. The function display panel contains electrically charged pigment carriers that can be moved under the influence of an electric field. A plurality of electrodes apply an electric field to the pigment carriers. The electrodes are each assigned to one display element of the function display panel.

27 Claims, 2 Drawing Sheets

REFRIGERATOR COMPRISING A FUNCTION DISPLAY UNIT

CROSS-REFERENCE TO RELATED APPLICATION

This is a continuing application, under 35 U.S.C. §120, of copending international application No. PCT/EP03/05865, filed Jun. 4, 2003, which designated the United States; this application also claims the priority, under 35 U.S.C. §119, of German patent application No. 102 27 132.1, filed Jun. 18, 2002; the prior applications are herewith incorporated by reference in their entirety.

BACKGROUND OF THE INVENTION

Field of the Invention

The present invention relates to a refrigerator comprising a thermally insulating housing and a function display panel. The function display panel is fitted to the housing and it displays functional states and/or operating parameters of the refrigerator.

Function display panels of this type conventionally comprise a plurality of lighted elements, such as small incandescent lamps, light-emitting diodes etc., or a liquid crystal display.

In order to function, the lighted elements must be continuously supplied with power, thus increasing the power consumption of the refrigerator. Although the power consumption of a liquid crystal display is substantially lower than that of a lighted display, a liquid crystal display with external illumination is often difficult to read in the case of an unfavorable incidence of light. Due to that fact, displays of that type are often provided with built-in light sources in order to improve their legibility, thus undoing the advantage of relatively low power consumption.

SUMMARY OF THE INVENTION

It is accordingly an object of the invention to provide a refrigerator with a function display panel, which overcomes the above-mentioned disadvantages of the heretofore-known devices and methods of this general type and which provides for an energy-saving device.

With the foregoing and other objects in view there is provided, in accordance with the invention, a refrigerator, comprising:

a thermally insulating housing; and a function display panel fitted to the housing for displaying functional states and/or operating parameters of the refrigerator;

the function display panel containing electrically charged pigment carriers movably disposed under an influence of an electric field, and having a plurality of electrodes each associated with a display element of the function display panel, for applying an electric field to the pigment carriers.

Electrically charged pigment carriers of this type and substrates provided with pigment carriers of this type are commercially available from the E-Ink Corporation, Cambridge, Mass.

The pigment carriers are preferably embedded in a liquid carrier layer in order to ensure their mobility.

According to a first refinement, the display panel comprises two types of pigment carrier which each carry opposite electrical charges and have different colors. The differently charged pigment carriers move in different directions under the influence of an electric field acting on the pigment carriers such that one type of pigment carrier gathers on a free surface of the function display panel and thus determines the color of said panel which is visible to a user, whereas the second type of pigment carrier collects in a deeper layer of the display panel where it is covered by the first type of pigment carrier and is not visible to the observer.

According to a second refinement, the display panel comprises a type of pigment carrier which has an electrical dipole moment and comprises two different pigments, one of these pigments being arranged in the vicinity of the positive electrical pole and the other pigment being arranged in the vicinity of the negative electrical pole. Under the influence of an electric field, a pigment carrier of this type tends to carry out a rotary movement during which the dipole moments in each case orient themselves in the direction of the field. With the aid of electrodes which produce fields which are oriented differently to a normal to the surface of the function display panel, it is possible in the case of this refinement to display not only the pure colors of the two pigments but also the intermediate tones.

The electrodes of the display panel necessarily include those electrodes which can be alternately connected to a positive and a negative supply voltage in order to change the color of a display element associated with the electrode in question. However, the refrigerator according to the invention may also contain electrodes which are permanently connected to a positive supply voltage or a negative supply voltage such that the color of the display panel associated with them cannot be changed. It is thereby possible to include in the display panel and also to display with the aid of the pigments static graphical elements such as a manufacturer's symbol or a model designation which cannot be produced in the display panel of a conventional refrigerator but are printed on the housing of the appliance in the area surrounding the display panel. It is therefore possible to completely dispense with different imprints on the display panels for different models of refrigerator. The different models are distinguished exclusively by means of the pattern of the electrodes which act on the pigment carriers.

Since the pigments invariably maintain their position permanently or at least over long periods of time in the absence of electric fields, it is not necessary to continuously apply a supply voltage to the electrodes. In order to prevent possible discoloration of the display as a result of thermally induced movements of the pigment carriers, a timer circuit may be provided which in each case briefly closes the main switch at time intervals of, for example, days or weeks, depending on the stability of the display.

Other features which are considered as characteristic for the invention are set forth in the appended claims.

Although the invention is illustrated and described herein as embodied in a refrigerator comprising a function display unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
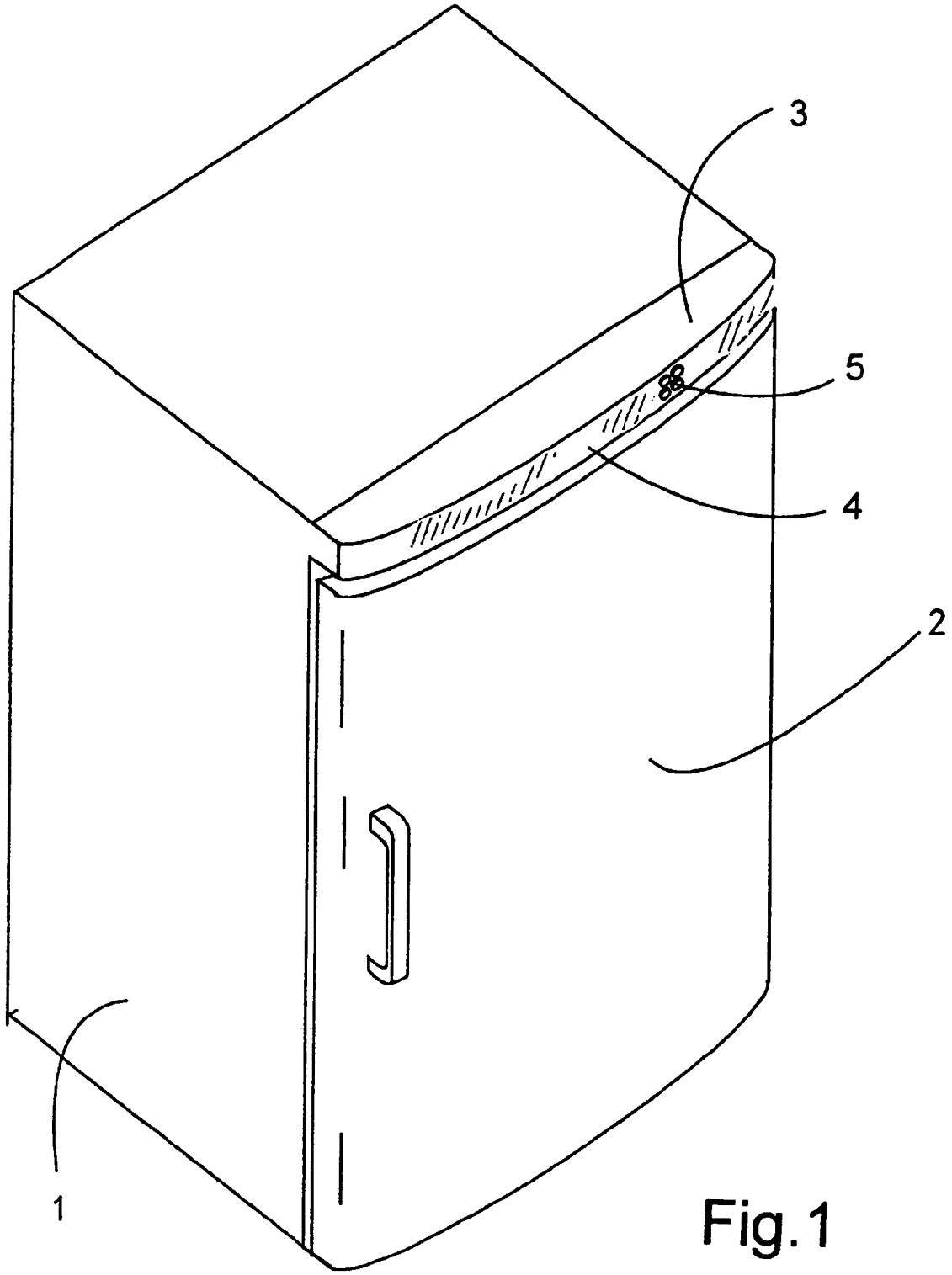
FIG. 1 is a perspective view of a refrigerator according to the invention before it is used for the first time.

Referring now to the figures of the drawing in detail and first, particularly, to FIG. 1 thereof, there is shown, in a perspective view, a refrigerator according to the invention. A door 2 is fitted to a thermally insulating housing 1 of the refrigerator. Above the door 2 there is disposed a hollow panel section 3 made of plastic. The entire front face of the panel section 3, which is flush with the door 2, is taken up by a display panel 4 whose structure will be described in more detail with reference to FIGS. 2 and 3. The interior of the hollow panel section 3 contains control electronics for the refrigerator controlling the operation of a compressor, for example on the basis of results acquired from a temperature sensor fitted in the interior of the refrigerator and from a temperature setting predefined by a user. A plurality of buttons 5 for controlling the operation of the refrigerator, for example for setting the temperature, extend through holes in the display panel 4. The display panel 4 is clear before it is used for the first time.

Figure 2:
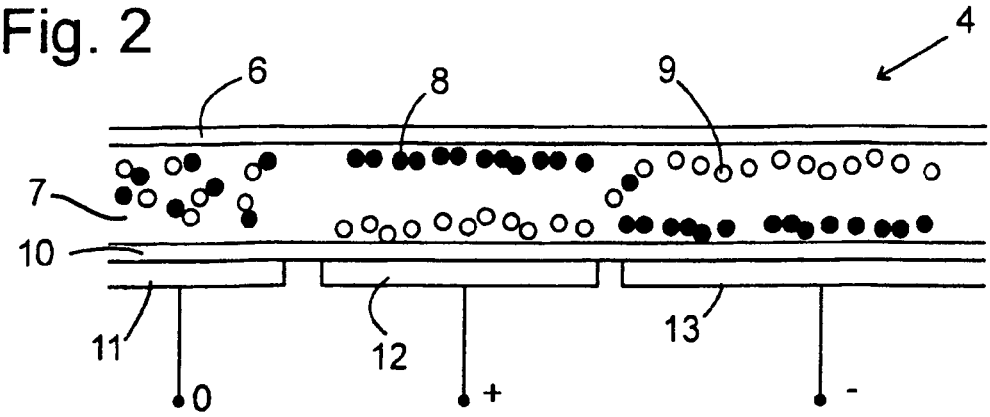
FIG. 2 is a schematic section through a function display panel of the refrigerator according to a first embodiment of the invention.

FIG. 2 shows a schematic section through the display panel 4 according to a first embodiment. A layer 7 made of a viscous liquid is incorporated between a solid outer layer 6 made of a transparent plastic and an inner layer 10 which may comprise a plastic film or be composed of any other material which is impermeable to the liquid of the layer 7. The outer layer 6 is preferably composed of the same plastic material as the parts of the panel section 3 which surround the display panel 4 and is integrally formed with said parts.

Pigment carriers 8 and 9, which, for example, respectively carry black and white pigment and each carry opposite electrical charges, float in the liquid layer 7.

On the other side of the inner layer 10, electrodes 11, 12, 13 for applying an electric field are arranged substantially normal to the surface facing the outer layer 6. A transparent ground electrode (not illustrated) is situated on the outer layer 6, opposite the electrodes 11, 12, 13.

Before an electrical potential is applied to one of the electrodes for the first time, the pigment carriers 8, 9 are in an unorganized state in which they tend to attract each other on account of their different electrical charges. This state is shown in the left-hand part of FIG. 2 above an electrode 11. The display panel of the refrigerator shown in FIG. 1 is in this state. Before the display panel is used for the first time, that is to say before a potential is applied to the electrodes of the display panel for the first time, the pigment carriers 8, 9 are randomly distributed in the display panel 4 and the display panel has an indeterminate gray color which is symbolized in FIG. 1 by hatched regions.

By applying a sufficiently strong electrical potential, for example a positive potential to the electrode 12 or a negative potential to the electrode 13 in FIG. 2, the pigment carriers 8, 9 are separated from one another, and the negatively charged white pigment carriers 8 migrate toward the positive electrode 12 or the side of the liquid layer 7 which faces away from the negative electrode 13, and the positively charged black pigment carriers 9 collect at the negative electrode 13 or on the side of the layer 7 which faces away from the positive electrode 12. The surfaces of the electrodes 12 and 13 therefore respectively appear black and white on the display panel 4.

Figure 3:
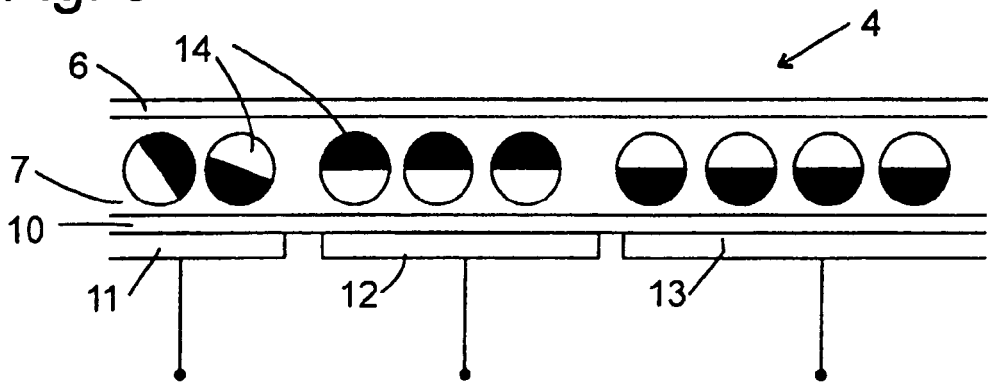
FIG. 3 is a section through a function display panel according to a second embodiment.

A similar effect is achieved by the display panel shown in the form of a schematic section in FIG. 3. The design of the display panel is substantially the same as that described with reference to FIG. 2. The difference is that the pigment carriers 14 are electrical dipoles and in each case contain different colored pigments in the vicinity of their electrical poles. In the case under consideration here, black pigment is present at the positive pole and white pigment is present at the negative pole. By applying an electrical potential to the electrodes 12, 13, the originally randomly oriented pigment carriers 14, as shown above the electrode 11, are aligned such that their black positive pole turns to face the outer layer 6 above the positive electrode 12 and their white negative pole turns to face the outer layer 6 above the negative electrode 13.

Figure 4:
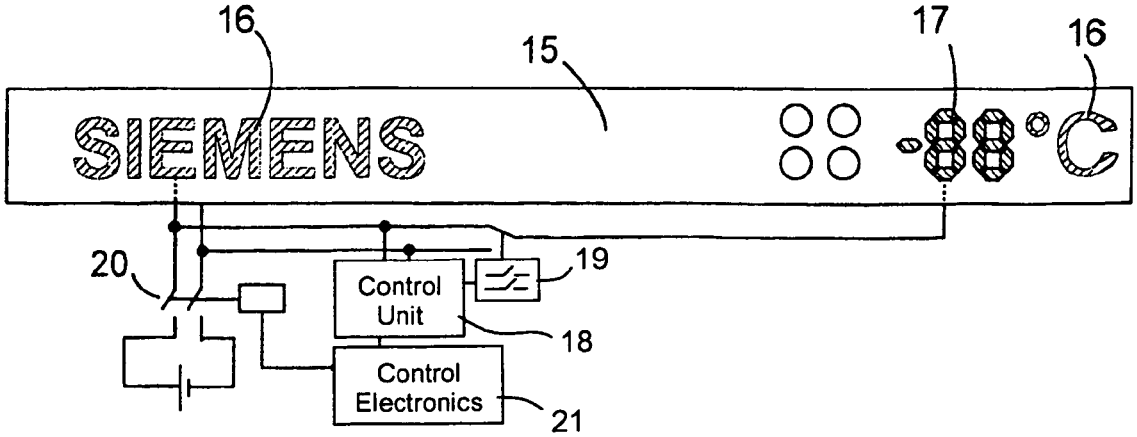
FIG. 4 is a schematic plan view of a printed circuit board with electrodes for activating the display panel and an exemplary display on the panel.

FIG. 4 shows a plan view of a printed circuit board arranged within the panel section 3, behind the inner layer 10 and with electrodes which face the inner layer 10. There are three types of electrode, one electrode 15 (shown in white in the figure) which takes up the majority of the surface of the printed circuit board, and, provided that the electrodes are supplied with voltage, is permanently connected to a negative potential, electrodes 16 (identified in the figure by an obliquely upward hatch) which are permanently connected to a positive potential when supplied with voltage, and electrodes 17 (illustrated with a obliquely downward hatch) to which both a positive and a negative potential may be applied by means of a control circuit 18. In this case, the electrodes 16 have the shape of letters in order to display a manufacturer's or model designation or other unchanging graphical elements. Since different models of refrigerator usually have different control circuits, a specifically produced printed circuit board is necessary for this purpose in any case. The extra outlay on production which is associated with patterning of the electrodes 16 on a printed circuit board of this type is low. It will be understood that it is not necessary to apply a manufacturer-specific or model-specific imprint to the panel section, with the result that wholly identical panel sections can be used for different models of refrigerator and costs can therefore be saved.

Electrodes 17, which by way of example are illustrated in FIG. 4 as electrodes of a seven segment display, can optionally be connected to a positive or a negative supply voltage by means of switches 19 which are controlled by the control circuit 18, in order to be able to switch the color of the elements of the display panel 4 which correspond to the electrodes 17. A main switch 20 is provided in order to disconnect all of the electrodes 15, 16, 17 and the control circuit 18 from their supply voltage and thus to be able to reduce the power consumption of the display panel 4 to zero. The main switch 20 is closed only in order to activate the display panel 4 when the control electronics 21 in the refrigerator report that the value of a parameter which can be displayed on the display panel 4, such as the internal temperature or an operating state, has changed and therefore the color of a display element in the panel 4 has to be changed. Since voltage is also applied to the electrodes 15, 16 which are at a fixed potential at such a point in time, the display panels associated with these electrodes are also refreshed from time to time and loss of contrast is avoided on these display panels too.

We claim:

1. A refrigerator, comprising:

a thermally insulating housing; and a function display panel fitted to the housing for displaying functional states and/or operating parameters of the refrigerator;

said function display panel including electrically charged pigment carriers movably disposed under an influence of an electric field; and a printed circuit board including:

a plurality of electrodes each associated with a display element of said function display panel, the plurality of electrodes configured to apply an electric field to said pigment carriers, wherein at least a first portion of the plurality of electrodes includes a first pattern of electrodes forming a static graphical element identifying one of a particular model of the refrigerator and a particular manufacturer of the refrigerator, and wherein at least a second portion of the plurality of electrodes includes a second pattern of electrodes forming a non-static graphical element that can be changed to display a value of a parameter of the refrigerator that changes based on a functional state of the refrigerator or an operating state of the refrigerator, a control circuit configured to receive a supply voltage and to provide the voltage to the plurality of electrodes, and a main switch configured to remove the supply voltage from the control circuit, wherein removal of the supply voltage removes the electric field, said pigment carriers maintaining their position when the electric field is removed, wherein the main switch connects the control circuit to the supply voltage to connect the plurality of electrodes to respective supply voltages to change an appearance of the non-static graphical element under the influence of the electric field when control electronics of the refrigerator detect a change in the value of the parameter of the refrigerator, and to refresh the static graphical element under the influence of the electric field without changing an appearance of the static graphical element, and wherein the main switch disconnects the control circuit from the supply voltage and the plurality of electrodes from the respective supply voltages to eliminate a power consumption of the display panel during times when the control electronics do not detect the change in the value of the parameter of the refrigerator wherein said first pattern of electrodes are only connected to a positive supply voltage when supplied with power and said second pattern of electrodes are switchably connected to a positive supply voltage and a negative supply voltage when supplied with power.

2. The refrigerator according to claim 1, further comprising a liquid carrier layer, and wherein said pigment carriers are embedded in said liquid carrier layer.

3. The refrigerator according to claim 1, wherein said pigment carriers are two types of pigment carriers carrying opposite electrical charges and having mutually different colors.

4. The refrigerator according to claim 1, wherein said pigment carriers have an electrical dipole moment and comprise first and second, mutually different, pigments, said first pigment being disposed in a vicinity of a positive electrical pole of the dipole and said second pigment being disposed in a vicinity of a negative electrical pole of the dipole.

5. The refrigerator according to claim 1, further comprising:

a drive circuit for closing said main switch in order to change an appearance of one of said display elements.

6. In combination with a refrigerator, a function display panel for displaying functional states and/or operating parameters of the refrigerator, the function display panel comprising:

electrically charged pigment carriers movably disposed under an influence of an electric field; and a printed circuit board including:

a plurality of electrodes each associated with a display element of said function display panel, for applying an electric field to said pigment carriers and for changing a display state of the display panel, wherein at least a first portion of the plurality of electrodes includes a first pattern of electrodes forming a static graphical element identifying one of a particular model of the refrigerator and a particular manufacturer of the refrigerator, and wherein at least a second portion of the plurality of electrodes includes a second pattern of electrodes forming a non-static graphical element that can be changed to display a value of a parameter of the refrigerator that changes based on a functional state of the refrigerator or an operating state of the refrigerator, a control circuit configured to provide power to the plurality of electrodes; and a main switch configured to supply power to or remove power from the control circuit and the plurality of electrodes, wherein removal of the supply voltage removes the electric field, said pigment carriers maintaining their position when the electric field is removed, wherein the main switch connects the control circuit to the supply voltage to connect the plurality of electrodes to respective supply voltages to change an appearance of the non-static graphical element under the influence of the electric field when control electronics of the refrigerator detect a change in the value of the parameter of the refrigerator, and to refresh the static graphical element under the influence of the electric field without changing an appearance of the static graphical element, and wherein the main switch disconnects the control circuit from the supply voltage and the plurality of electrodes from the respective supply voltages to eliminate a power consumption of the display panel during times when the control electronics do not detect the change in the value of the parameter of the refrigerator wherein said first pattern of electrodes are only connected to a positive supply voltage when supplied with power and said second pattern of electrodes are switchably connected to a positive supply voltage and a negative supply voltage when supplied with power.

7. The function display panel according to claim 6, wherein said pigment carriers are embedded in a liquid carrier layer.

8. The refrigerator according to claim 1, further comprising:

a door fitted to a thermally insulating housing; and a panel section above the door having, wherein the function display panel is fitted to the panel section.

9. The refrigerator according to claim 8, wherein the panel section includes control electronics for controlling the operation of a compressor connected with the refrigerator.

10. A refrigerator display for a refrigerator, comprising:

a transparent ground electrode;

a printed circuit board including a plurality of electrodes, wherein at least a first portion of the plurality of electrodes includes a first pattern of electrodes forming a static graphical element identifying one of a particular model of the refrigerator and a particular manufacturer of the refrigerator, and wherein at least a second portion of the plurality of electrodes includes a second pattern of electrodes forming a non-static graphical element that can be changed to display a value of a parameter of the refrigerator that changes based on a functional state of the refrigerator or an operating state of the refrigerator; and a plurality of electrically charged pigment carriers configured to move under the influence of an electrical field between the transparent ground electrode and the second electrodes and to maintain position in the absence of the electric field;

a control circuit configured to provide power to the plurality of electrodes; and a main switch configured to supply power to or remove power from the control circuit and the plurality of electrodes, wherein removal of the supply voltage removes the electric field, the pigment carriers maintaining their position when the electric field is removed, wherein the main switch connects the control circuit to the supply voltage to connect the plurality of electrodes to respective supply voltages to change an appearance of the non-static graphical element under the influence of the electric field when control electronics of the refrigerator detect a change in the value of the parameter of the refrigerator, and to refresh the static graphical element under the influence of the electric field without changing an appearance of the static graphical element, and wherein the main switch disconnects the control circuit from the supply voltage and the plurality of electrodes from the respective supply voltages to eliminate a power consumption of the display panel during times when the control electronics do not detect the change in the value of the parameter of the refrigerator wherein said first pattern of electrodes are only connected to a positive supply voltage when supplied with power and said second pattern of electrodes are switchably connected to a positive supply voltage and a negative supply voltage when supplied with power.

11. The refrigerator display of claim 10, wherein the pigment carriers are stable for more than one day in the absence of the electrical field.

12. The refrigerator display of claim 10, wherein, during the times when the control electronics do not detect the change in the value of the parameter of the refrigerator, the main switch connects the control circuit to the supply voltage to connect the plurality of electrodes to respective supply voltages to refresh the non-static graphical element and the static graphical element under the influence of the electric field without changing an appearance of the non-static graphical element and the static graphical element at a predetermined time interval to maintain the appearance of the non-static graphical element and the static graphical element of the refrigerator display.

13. The refrigerator display of claim 12, wherein the electrical field is energized by the main switch one of once a day and once a week.

14. The refrigerator according to claim 1, wherein the function display panel is refreshed by the main switch one of once a day and once a week.

15. The refrigerator according to claim 1, wherein the function display panel is updated by the main switch only when information to be displayed changes.

16. The refrigerator according to claim 1, wherein, during the times when the control electronics do not detect the change in the value of the parameter of the refrigerator, the main switch connects the control circuit to the supply voltage to connect the plurality of electrodes to respective supply voltages to refresh the non-static graphical element and the static graphical element under the influence of the electric field without changing an appearance of the non-static graphical element and the static graphical element at a predetermined time interval to maintain the appearance of the non-static graphical element and the static graphical element of the refrigerator display.

17. The refrigerator according to claim 16, wherein the electrical field is energized by the main switch one of once a day and once a week.

18. The refrigerator according to claim 1, wherein the pattern of the static graphical element corresponds to a name of one of the manufacturer of the refrigerator and the model of the refrigerator.

19. The refrigerator according to claim 1, wherein a color of the static graphical element is unchanged under the influence of the electric field, and wherein a color of the non-static graphical element is changed under the influence of the electric field.

20. The function display panel according to claim 6, wherein the pattern of electrodes forming the static graphical element corresponds to a name of one of the manufacturer of the refrigerator and the model of the refrigerator.

21. The function display panel according to claim 6, wherein a color of the static graphical element is unchanged under the influence of the electric field, and wherein a color of the non-static graphical element is changed under the influence of the electric field.

22. The refrigerator display according to claim 10, wherein the pattern of electrodes forming the static graphical element corresponds to a name of one of the manufacturer of the refrigerator and the model of the refrigerator.

23. The refrigerator display according to claim 10, wherein a color of the static graphical element is unchanged under the influence of the electric field, and wherein a color of the non-static graphical element is changed under the influence of the electric field.

24. The refrigerator of claim 1, wherein the plurality of electrodes includes a third pattern of electrodes forming a second static graphical element identifying another graphical element that is not changed.

25. The refrigerator according to claim 1, wherein the main switch, the control circuit and the supply voltage are connected by a wired connection and the main switch is adapted to disconnect the wired connection.

26. The function display panel according to claim 6, wherein the main switch, the control circuit and the supply voltage are connected by a wired connection and the main switch is adapted to disconnect the wired connection.

27. The refrigerator display of claim 10, wherein the main switch, the control circuit and the supply voltage are connected by a wired connection and the main switch is adapted to disconnect the wired connection.

* * * * *